United States Patent [19]

Itou et al.

[11] 4,385,602

[45] May 31, 1983

[54] ROTATIONAL SPEED CONTROL DEVICE DURING IDLING OF ENGINE

[75] Inventors: Hiroshi Itou; Haruo Watanabe; Hidenori Tateno; Mamoru Kobashi, all of Aichi, Japan

[73] Assignee: Toyota Jidosha Kogyo Kabushiki Kaisha, Toyota, Japan

[21] Appl. No.: 286,347

[22] Filed: Jul. 23, 1981

[30] Foreign Application Priority Data

Jul. 25, 1980 [JP] Japan ..... 55-102782

[51] Int. Cl.[3] ..... F02D 33/02

[52] U.S. Cl. ..... 123/339; 123/585

[58] Field of Search ..... 123/327, 339, 585, 589, 123/DIG. 11

[56] References Cited

U.S. PATENT DOCUMENTS 3,964,457 6/1976 Coscia ..... 123/585

4,083,337 4/1978 Hattori et al. ..... 123/DIG. 11

*Primary Examiner*—William A. Cuchlinski, Jr.

*Attorney, Agent, or Firm*—Cushman, Darby & Cushman

[57] ABSTRACT

An idling rotational speed control device wherein, when an engine ignition switch is turned off, an air flow rate control device is driven to a fully closed position or a fully opened position, and the air flow rate control valve is controlled referenced from the fully closed position or the fully opened position as the new reference position. During idling, the flow rate of air taken into an intake manifold is controlled by the intentional opening degree from the reference position of the air flow rate control valve so as to correctly perform control.

6 Claims, 6 Drawing Figures

ROTATIONAL SPEED CONTROL DEVICE DURING IDLING OF ENGINE

BACKGROUND OF THE INVENTION

1. Field of the Invention

This invention relates to a rotational speed control device during idling of an engine, and more particularly to improvements in an idling rotational speed control device suitable for use in a motor car, comprising: intake air flow rate control means for controlling intake air flow rate during idling; a step motor for driving the intake air flow rate control means; and an electronic control circuit for controlling the step motor in accordance with the operating conditions of the engine.

2. Description of the Prior Art

In general, in engines including engines for motor cars, etc., there have been used idling rotational speed control devices for holding smooth rotating condition of the engines even when a driver removes his foot from an accelerator pedal and a throttle valve is fully closed, i.e., under no load condition, etc. One of the idling rotational speed control devices of the type described includes: intake air flow rate control means for controlling intake air flow rate during idling, i.e., when the throttle valve is fully closed; a step motor for driving the intake air flow rate control means; and an electronic control circuit for controlling the step motor in accordance with the operating conditions of the engine. For instance, in case this idling rotational speed control device is used in an engine comprising: a throttle body having a throttle valve for controlling intake air flow rate; and a fuel injection valve for injecting fuel to air taken into an intake manifold through the throttle body, a bypass passage for bypassing the throttle valve of the throttle body and, during idling, i.e., when the throttle valve is fully closed, the opening area of the bypass passage is controlled by an air flow rate control valve driven by the step motor so as to control the intake air flow rate during idling. With the idling rotational speed control device provided with the air flow rate valve driven by the step motor as described above, in the electronic control circuit, the increase or decrease in pulse number for driving the step motor from the reference position is calculated, whereby the opening degree of the air flow rate control valve is brought into register with the position of the step motor stored in the electronic control circuit, so that the opening degree of the air flow rate control valve can be detected. However, during operating conditions of the engine, the opening degree of the air flow rate control valve should not necessarily correpond to the reference position, and, if the opening degree of the air flow rate control valve is forced to be one corresponding to the reference position during normal running condition, then there occurs a possibility of that the operating performance of the vehicle is impaired. Consequently, normally, at the time of starting the engine, firstly the step motor is driven in either fully opened direction or fully closed direction, the reference position is passed therethrough once, the number of the steps in the step motor is brought to correspond to the opening degree of the intake air flow rate control valve, and thereafter, the normal control is effected. However, in the abovedescribed method wherein the reference position is passed therethrough in the beginning step of control at the time of starting the engine, it may take a time to pass through the reference position depending on the correlation between the reference position thus set and the opening degree of the air flow rate control valve when the engine is stopped in operation, and, during this time taken, the idling rotational speed is not effected, thus presenting a disadvantage particularly when rapid control action is required as at the time of starting the engine.

In addition, there have been proposed the provision of a potentiometer for constantly detecting the opening degree of the air flow rate control valve or the provision of a position sensor such as a limit switch for detecting the specific opening degree of the air flow rate control valve. Each of the abovedescribed provisions results in complicated arrangement and decreased reliability, and moreover, such problems are presented as decreased accuracy in the detecting performance of the position sensor, i.e., dispersion in the accuracy in the detecting performance thereof depending on the positions where the position sensor is installed.

SUMMARY OF THE INVENTION

The present invention has been developed to obviate the abovedescribed disadvantages of the prior art and has as one object the provision of an idling rotational speed control device capable of easily making the opening degree of an intake air flow rate control means correspond to the number of steps of a step motor without providing a reference position sensor and avoiding to impair the starting performance of an engine.

The present invention has as another object the provision of an idling rotational speed control device wherein the intake air flow rate control means is opened to a predetermined opening degree to stop the engine in operation so as to prevent a failure in operation of the intake air flow rate control means due to icing thereof.

According to the present invention, upon turning off of an engine ignition switch, the intake air flow rate control means is driven to either a fully closed position or a fully opened position, and then, either the fully closed position or the fully opened position is set as a reference position. Consequently, during idling, the intentional opening degree of the intake air flow rate control means can be accurately determined from the reference position.

BRIEF DESCRIPTION OF THE DRAWINGS

The abovementioned features and objects of the present invention will become more apparent by reference to the following description taken in conjunction with the accompanying drawings, wherein like referenced numerals denote like elements, and in which.

DETAILED DESCRIPTION OF THE INVENTION

Figure 1:
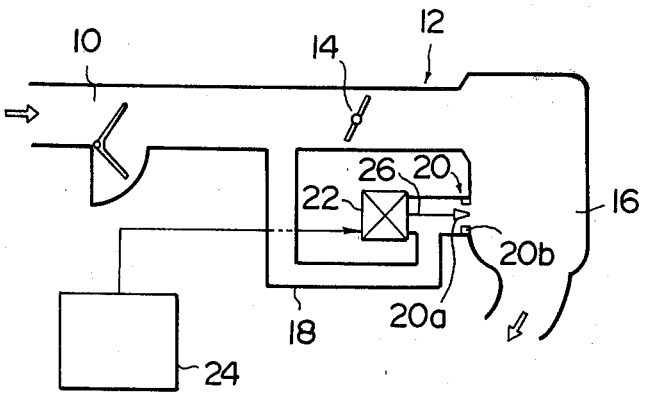
FIG. 1 is a schematic diagram showing the idling rotational speed control device in the electronic fuel injection type engine to which the present invention is applied.
Figure 2:
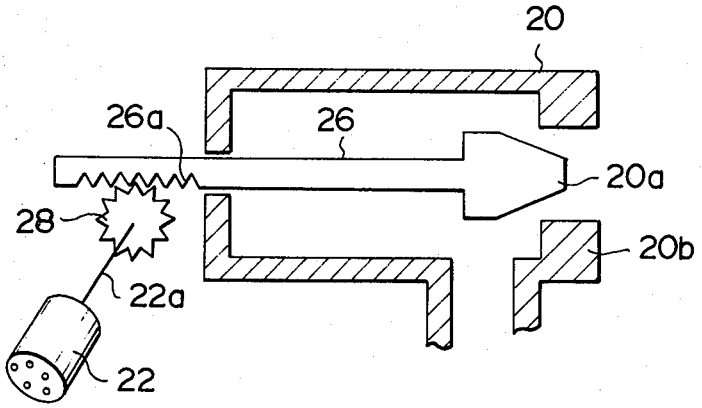
FIG. 2 is an enlarged sectional view showing the vicinity of the air flow rate control valve shown in FIG. 1.

Detailed description will hereunder be given of an embodiment of the present invention with reference to the drawings. As shown in FIGS. 1 and 2, in this embodiment, the present invention is applied to the idling rotational speed control device for use in an electronic fuel injection type engine comprising: an air flow meter 10 for metering a clean air taken in through an air cleaner, not shown; a throttle body 12 provided therein with a throttle valve 14 for controlling the intake air flow rate; and an intake manifold 16; wherein the idling rotational speed control device further comprises: a bypass passage for bypassing the throttle valve 14 of the throttle body 12; an air flow rate control valve 20 provided at the intermediate portion of the bypass passage 18 and including a valve body 20*a* and a valve seat 20*b* for controlling the intake air flow rate flowing into the intake manifold 16 through the bypass passage 18 by controlling the opening area of the bypass passage during idling, i.e., when the throttle valve 14 is fully closed; a step motor 22 for driving the valve body 20*a* of the air flow rate control valve 20 through a shaft 26 solidly secured to the valve body 20*a* of the air flow rate control valve 20; and an electronic control circuit 24 for controlling the step motor in accordance with the operating conditions of the engine including the intake air flow rate metered by the air flow meter 10, the R.P.M. of the engine, the cooling water temperature, the working condition of an air conditioner, an output from a throttle switch for detecting the fully closed state of the throttle valve 14, the vehicle speed and the like.

As detailedly shown in FIG. 2, the valve body 20*a* of the air flow rate control valve 20 and the step motor 22 are interlocked with each other by a shaft 26 solidly secured at the forward end thereof to the valve body 20*a* of the air flow rate control valve 20 and formed at the rear end thereof with a rack 26*a* and a pinion 28 mounted on a rotary shaft 22*a* of the step motor is converted to a rectilinear displacement of the valve body 20*a*.

Figure 3:
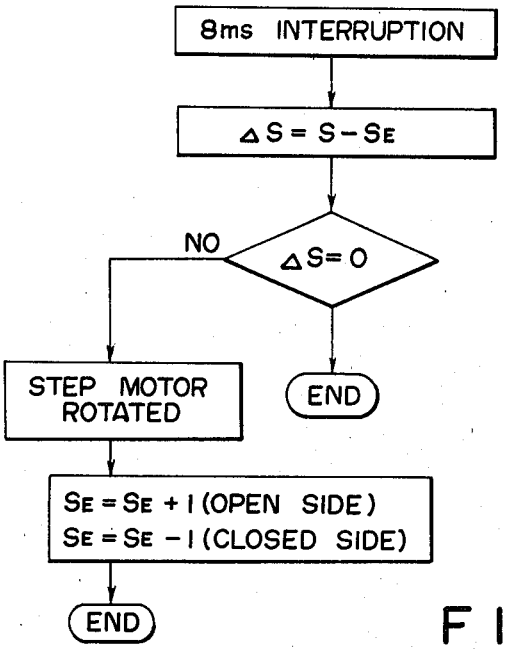
FIG. 3 is a flow chart showing the process of processing the rotation of the step motor in an embodiment of the present invention.
Figure 4:
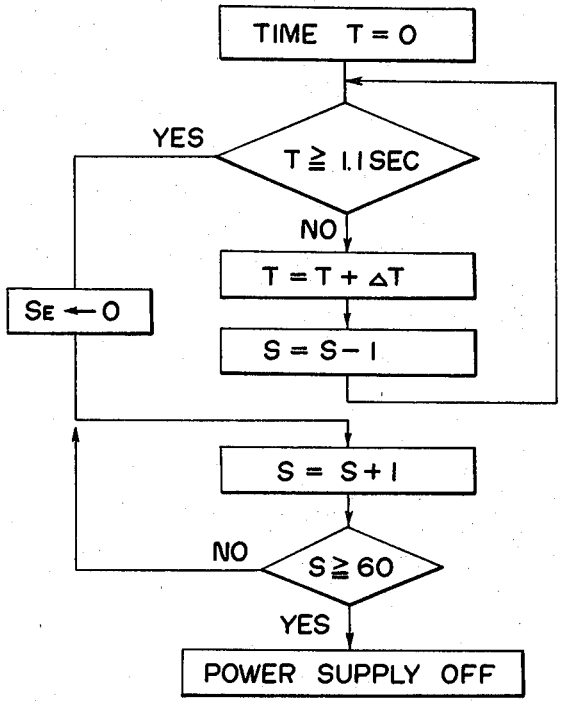
FIG. 4 is a flow chart showing the process of controlling the step motor immediately after the engine ignition switch it turned off according to the present invention.
Figure 5:
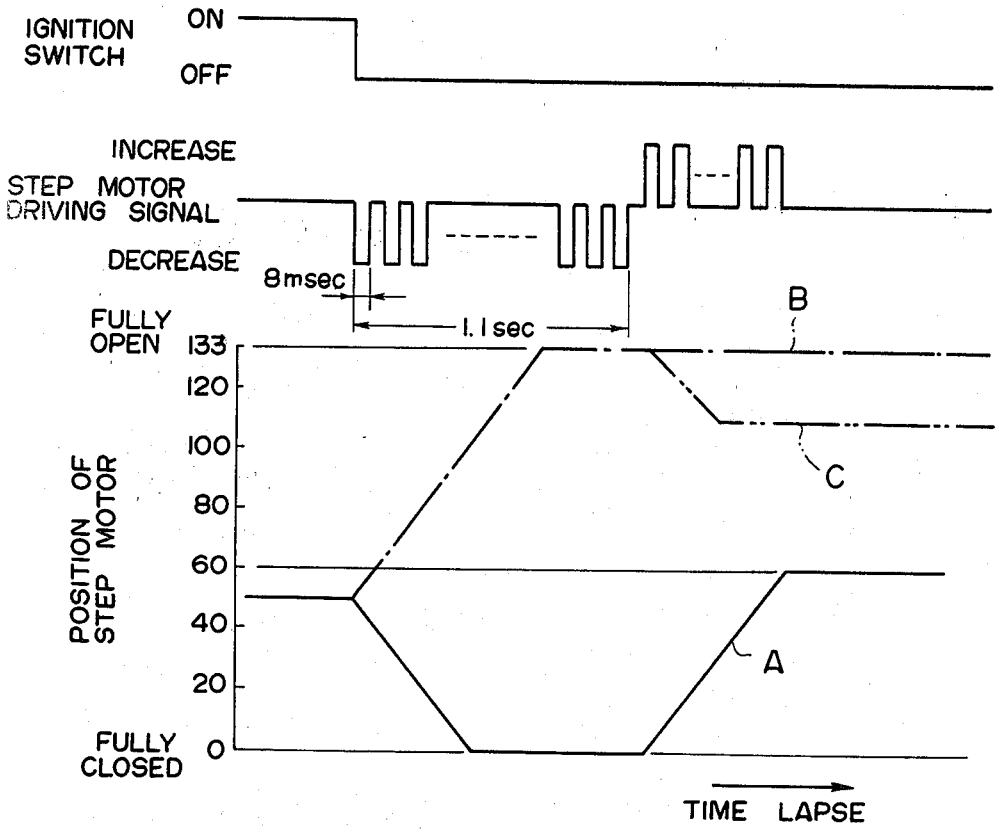
FIG. 5 is a diagram showing the relationship between the time lapse and the position of the step motor.

Description will hereunder be given of action. The intake air, which has passed through the air flow meter 10, flows into the intake manifold 16 via the air flow rate control valve 20 provided in the bypass passage 18 by bypassing the throttle valve 14 at fully opened state. The air flow rate control valve 20 controls the air flow rate by means of an electronic control circuit 24. FIG. 3 is a flow chart showing the process of processing the rotation of the step motor 22 per 8 milliseconds in the electronic control circuit 24, in which process the step motor 22 is driven only when a difference $\Delta S$ between the present position $S_E$ of the step motor and the intentional position S is not zero, but, is not driven when the difference is zero. By this process, the step motor 22 is controlled to the intentional position. FIG. 4 is a flow chart showing the process of controlling the step motor immediately after the engine ignition switch is turned off according to the present invention. The step motor 22 in this embodiment requires 133 pulses for its advance from the fully closed position to the fully opened position and the working speed of the step motor is 125 pps, so that the step motor at any position can reach the fully closed position of the air flow rate control valve 20 without fail if the step motor is controlled to the closing side for 1.1 sec. Consequently, at that time, the present position $S_E$ of the step motor is set at zero. Thereafter, the intentional position S is successively raised to a position where $S=60$, i.e., substantially the intermediate position between the fully closed position and the fully opened position. After the abovedescribed control is completed, the power source is turned off. In FIG. 5, the progress of controlling in this embodiment is indicated by a solid line.

Further, in this embodiment, the reference position of control is set at the fully closed position of the air flow rate control valve 20. When the step motor 22 is stopped in operation as in the fully closed position, icing is caused to the valve body and the valve seat, particularly under a low temperature, thus presenting a danger of the air flow rate control valve 20 being unable to open. Consequently, in this embodiment, to eliminate the possibility of the icing when the air flow rate control valve is held under a low temperature, the air flow rate control valve 20 is opened to step 60, under which condition the step motor 22 is stopped in operation.

Additionally, in this embodiment, the reference position of control is set at the fully closed position, however, it is not limited to this specific position and may be set at the fully opened position. In this case, since the possibility of the icing is eliminated, the step motor may be stopped at the fully opened position as indicated by one-dot chain lines B in FIG. 5, or the step motor may be stopped in operation at a position where the step motor is driven slightly to the closed direction from the fully opened position to thereby prevent R.P.M. of the engine from being excessively high during starting under a high temperature as indicated by two-dot chain lines C in FIG. 5.

Figure 6:
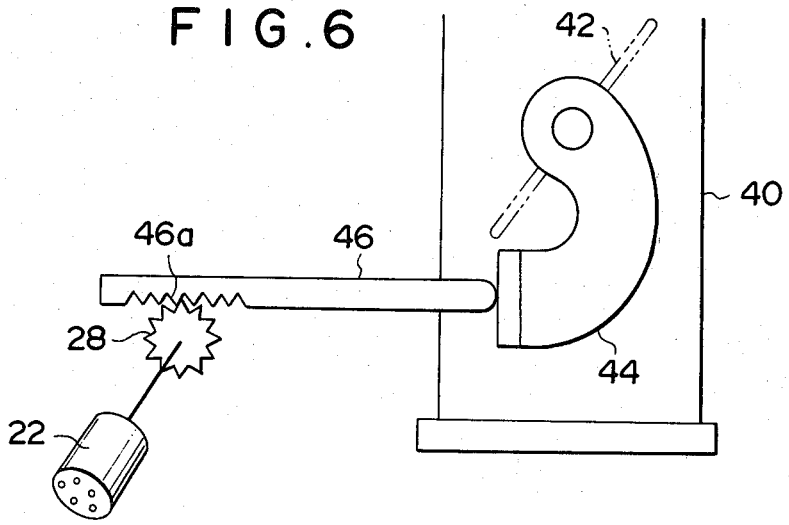
FIG. 6 is a schematic diagram showing the arrangement of the idling rotational speed control device in a carburetor type engine to which the present invention is applicable.

In the abovedescribed embodiment, the present invention is applied to the idling rotational speed control device used in an electronic fuel injection type engine, however, the scope of application of the present invention should not necessarily be limited to this specific form, but, it is apparent that the present invention may be applied to an idling rotational speed control device of a carburetor type engine, in which, as shown in FIG. 6, a throttle valve lever 44 is provided in a throttle valve 42 of a carburetor 40, the lower end of the throttle valve lever 44 is pushed to the right in the drawing by a shaft 46 to slightly open the throttle valve 42 when the throttle valve 42 is fully closed, whereby the intake air flow rate is controlled during idling. In the drawing, designated at 46*a* is a rack formed at the rear end of the shaft 46 for being meshed with the pinion 28 of the step motor 22.

As has been described hereinabove, according to the present invention, the opening degree of the intake air flow rate control means can be easily made to correspond to the number of steps of the step motor without providing a reference position sensor. Furthermore, since the work of bringing the reference position of control to a predetermined position is carried out immediately after the engine ignition switch is turned off, so that such an advantage can be offered that no problem is posed in the responsiveness during starting under a low temperature.

From the foregoing description, it should be apparent to one skilled in the art that the abovedescribed embodiment is but one of many possible specific embodiments which can represent the applications of the principles of the present invention. Numerous varied other arrangements can be readily devised by those skilled in the art without departing from the spirit and scope of the invention.

What is claimed is:

1. An idling rotational speed control device used in an internal combustion engine, comprising:

intake air flow rate control means for being opened or closed to control to a desired value an intake air flow rate taken into an intake manifold during idling of the engine;

driving means for being driven gradually by a predetermined value in accordance with the number of pulses of pulse signals to open or close said intake air flow rate control means; and electronic control means for feeding to said driving means the pulse signals so that the step number determined by adding the pulse number of the pulse signals to a preset reference number or subtracting the pulse number of the pulse signals from the preset reference number and indicating the present position of said driving means is coincided with a desired step number which is preset and indicates a desired position of said driving means, during idling of the engine, so as to effect such a control that the present position of said driving means coincides with the desired position, and further, for feeding the pulse signals having a predetermined pulse number to said driving means after an ignition switch is opened, to cause said driving means to control said intake air flow rate control means to a maximum open degree or a minimum open degree, and initializing the step number indicating the present position of said driving means to the reference number after the pulse signals having the predetermined pulse number are fed to said driving means.

2. An idling rotational speed control device used in an internal combustion engine, comprising:

a bypass passage which bypasses a throttle valve provided in a throttle body and is connected to an intake manifold;

an air flow rate control valve provided at an intermediate portion of said bypass passage for controlling the flow rate of air flowing into the intake manifold by controlling the opening area of said bypass passage during idling of the engine;

a step motor for driving said air flow rate control valve; and electronic control means for feeding to said step motor the pulse signals so that the step number determined by adding the pulse number of the pulse signals to a preset reference number or subtracting the pulse number of the pulse signals from the preset reference number and indicating the present position of said step motor is coincided with a desired step number which is preset and indicates a desired position of said step motor, during idling of the engine, so as to effect such a control that the present position of said step motor coincides with the desired position, and further, for feeding the pulse signals having a predetermined pulse number to said step motor after an ignition switch is opened, to cause said step motor to control said intake air flow rate control valve to a maximum open degree or a minimum open degree, and initializing the step number indicating the present position of said step motor to the reference number after the pulse signals having the predetermined pulse number are fed to said step motor.

3. An idling rotational speed control device used in an engine as set forth in claim 2, wherein a shaft formed with a rack is solidly secured to the valve body of said air flow rate control valve and a pinion being meshed with said rack is fixed to a rotary shaft of said step motor.

4. An idling rotational speed control device used in an internal combustion engine, comprising:

a throttle valve lever which is provided on a throttle valve disposed in a throttle body;

a shaft for opening or closing the throttle lever by pushing one end of said throttle valve lever;

a step motor for reciprocating said shaft so that said shaft can push one end of said throttle valve lever; and electronic control means for feeding to said step motor the pulse signals so that the step number determined by adding the pulse number of the pulse signals to a preset reference number or subtracting the pulse number of the pulse signals from the preset reference number and indicating the present position of said step motor is coincided with a desired step number which is preset and indicates a desired position of said step motor, during idling of the engine, so as to effect such a control that the present position of said step motor coincides with the desired position, and further, for feeding the pulse signals having a predetermined pulse number to said step motor after an ignition switch is opened, to cause said step motor to control said throttle valve to a maximum open degree or a minimum open degree, and initializing the step number indicating the present position of said step motor to the reference number after the pulse signals having the predetermined pulse number are fed to said step motor.

5. An idling rotational speed control device used in an engine as set forth in claim 3, wherein a rack is formed on said shaft and a rotary shaft of said step motor is solidly secured thereto with a pinion being meshed with the rack.

6. An idling rotational speed control device used in the engine as set forth in claim 1, 2, 3, 4 or 5, wherein said electronic control means emits the pulse signals of the predetermined pulse number after the step number indicating the present position of said driving means is initialized to the reference number.

* * * * *